US006325178B2

(12) United States Patent
Hikita et al.

(10) Patent No.: US 6,325,178 B2
(45) Date of Patent: Dec. 4, 2001

(54) ELEVATOR GROUP MANAGING SYSTEM WITH SELECTIVE PERFORMANCE PREDICTION

(75) Inventors: Shiro Hikita; Shinobu Tajima, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/727,786

(22) Filed: Dec. 4, 2000

Related U.S. Application Data

(63) Continuation of application No. PCT/JP99/04186, filed on Aug. 3, 1999.

(51) Int. Cl.[7] ..... B66B 1/18
(52) U.S. Cl. ..... 187/382; 187/384; 187/387
(58) Field of Search ..... 187/380, 381, 187/382, 384, 385, 387

(56) References Cited

U.S. PATENT DOCUMENTS

| | | | | |
|---|---|---|---|---|
| 4,760,896 | * | 8/1988 | Yamaguchi | 187/124 |
| 5,233,138 | * | 8/1993 | Amano | 187/127 |
| 5,250,766 | | 10/1993 | Hikita et al. | 187/133 |
| 5,283,399 | * | 2/1994 | Fujino et al. | 187/124 |
| 5,306,878 | * | 4/1994 | Kubo | 187/127 |
| 5,412,163 | * | 5/1995 | Tsuji | 187/382 |
| 5,612,519 | * | 3/1997 | Chenais | 187/382 |
| 5,767,461 | * | 6/1998 | Nakagawa et al. | 187/382 |
| 5,923,004 | * | 7/1999 | Whitehall et al. | 187/382 |
| 5,936,212 | * | 8/1999 | Whitehall et al. | 187/382 |
| 6,000,504 | * | 12/1999 | Koh et al. | 187/382 |

FOREIGN PATENT DOCUMENTS

| | | |
|---|---|---|
| 2-261785 | 10/1990 | (JP) . |
| 6-107381 | 4/1994 | (JP) . |
| 6-263346 | 9/1994 | (JP) . |
| 7-61723 | 3/1995 | (JP) . |
| 8-255298 | 10/1996 | (JP) . |

* cited by examiner

*Primary Examiner*—Jonathan Salata
(74) *Attorney, Agent, or Firm*—Leydig, Voit & Mayer, Ltd.

(57) ABSTRACT

A rule base storing control rule sets predicts elevator group management performance, such as waiting time distribution, obtained when applying each rule set stored in the rule base to the current traffic situation, and selects a rule set in accordance with a performance prediction. In addition, a weight database stores weighting parameters of a neural network corresponding to the rule sets and performance learning measures for correcting the weighting parameters in accordance with learning by the neural network. As a result, the optimal rule set is applied at all times for group management control of the elevators to provide passengers with excellent service and to enhance prediction accuracy in correspondence with the actual operational situation of the elevators.

3 Claims, 4 Drawing Sheets

ELEVATOR GROUP MANAGING SYSTEM WITH SELECTIVE PERFORMANCE PREDICTION

CROSS REFERENCE TO RELATED APPLICATION

This is a continuation of International Application PCT/JP99/04186, with an international filing date of Aug. 3, 1999 and designating the United States, the contents of which is hereby incorporated by reference into the present application.

TECHNICAL FIELD

The present invention relates to an elevator group managing system for managing and controlling efficiently a plurality of elevators in a group.

BACKGROUND ART

In general, in the system in which a plurality of elevators go into commission, group management control is carried out. There are carried out therein various types of controls such as the assignment control for selecting an optimally assigned elevator in response to a call which has occurred in a hall. A forwarding operation is carried out in a peak time for a a specific floor differently from the occurrence of the call, and service zone may be divided.

In recent years, for example, as disclosed in Japanese Patent No. 2664766 or Japanese Patent Application Laid-open No. Hei 7-61723, there has been proposed a method of predicting the control result of the group management, i.e., group management performance such as waiting time and the like to set the control parameters.

In accordance with the above-mentioned two prior art publication, there is stated a system in which a neural network for receiving as its input traffic demand parameters and evaluation arithmetic operation parameters when carrying out the call assignment to output group management performance is employed, and the output result of the neural network is evaluated to set the optimal evaluation arithmetic operation parameter.

However, in the above-mentioned two articles relating to the prior art, a parameter which is set on the basis of the group management performance prediction result is limited to the single evaluation arithmetic operation parameter when carrying out the assignment. Thus, carrying out the arithmetic operation employing such a single evaluation arithmetic operation parameter when carrying out a call assignment leads in the limitation to the enhancement of the transport performance. That is, the various rule sets such as the forwarding operation and the zone division needs to be utilized depending on the traffic situation and hence excellent group management performance can not be obtained.

In addition, while the neural net has the advantage that its accuracy of arithmetic operation can be enhanced by learning, at the same time, it has also the disadvantage that it takes a lot of time for the accuracy of the arithmetic operation to reach a practical level.

In the system which is disclosed in the above-mentioned two articles relating to the prior art, it is impossible to obtain the expected group management performance unless the learning of the neural net is previously carried out in the factory. In addition, in a case where the traffic demand is abruptly changed due to a change of tenants in an associated building, it is possible to cope speedily with the change.

In the light of the foregoing, the present invention has been made in order to solve the above-mentioned problems associated with the prior art, and it is therefore an object of the present invention to provide an elevator group managing system which can select the optimal rule set in accordance with the performance prediction result to provide excellent service at all times.

DISCLOSURE OF THE INVENTION

According to an elevator group managing system of one aspect of the present invention, an elevator group managing system for managing a plurality of elevators in a group, includes: traffic situation detecting means for detecting the current traffic situation of a plurality of elevators; a rule base for storing therein a plurality of control rule sets; performance predicting means for predicting the group management performance which is obtained when applying an arbitrary rule set stored in the rule base to the current traffic situation; rule set selecting means for selecting the optimal rule set in accordance with the prediction result obtained from the performance predicting means; and operation control means for carrying out the operation control for each of the elevator cars on the basis of the rule set which has been selected by the rule set selecting means.

In addition, an elevator group managing system further includes a weight database for storing therein weight parameters of a neural net corresponding to an arbitrary rule set stored in the rule base, and the system is characterized in that the performance predicting means, for the specific rule set stored in the rule base, fetches the weight parameters of the neural net corresponding to the specific rule set from the weight database to carry out the prediction of the group management performance by the neural net using the weight parameters thus fetched.

In addition, an elevator group managing system further includes performance learning means for comparing the prediction result provided by the performance predicting means with the actual group management performance after having applied the specific rule set to carry out the learning of the neural net to correct the weight parameters stored in the weight database in accordance with the learning result, and the system is characterized in that the performance predicting means carries out the prediction of the group management performance by the neural net using the corrected weight parameters.

In addition, an elevator group managing system is characterized in that the performance predicting means, on the basis of the mathematical model, predicts the group management performance which is predicted when applying an arbitrary rule set stored in the rule base to the current traffic situation.

Furthermore, according to an elevator group managing system of another aspect of the present invention, an elevator group managing system for managing a plurality of elevators in a group, includes: traffic situation detecting means for detecting the current traffic situation of a plurality of elevators; a rule base for storing therein a plurality of control rule sets; first performance predicting means for on the basis of a neural net, predicting the group management performance which is obtained when applying an arbitrary rule set stored in the rule base to the current traffic situation; a weight database for storing therein weight parameters of the neural net corresponding to the arbitrary rule set stored in the rule base; and performance learning means for comparing the prediction result provided by the first performance predicting means with the actual group management performance after having applied the specific rule set to carry out the learning of the neural net to correct the weight parameters stored in the weight database in accordance with the learning result, wherein the first performance predicting means carries out the prediction of the group management performance by the neural net using the corrected weight performance, and wherein the system further includes: second performance predicting means for on the basis of the mathematical model, predicting the group management performance which is predicted when applying an arbitrary rule set stored in the rule base to the current traffic situation; performance prediction accuracy evaluating means for comparing the prediction results provided by the first and second performance predicting means with the actual group management performance to determine which of the first or second performance predicting means is employed in accordance with the comparison result; rule set selecting means for selecting the optimal rule set in accordance with the prediction result, from either the first or second performance predicting means, which has been determined by the performance prediction accuracy evaluating means; and operation control means for carrying out the operation control for each of the elevator cars on the basis of the rule set which has been selected by the rule set selecting means.

BEST MODE FOR CARRYING OUT THE INVENTION

Embodiment 1

An embodiment of the present invention will hereinafter be described with reference to the accompanying drawings.

Figure 1:
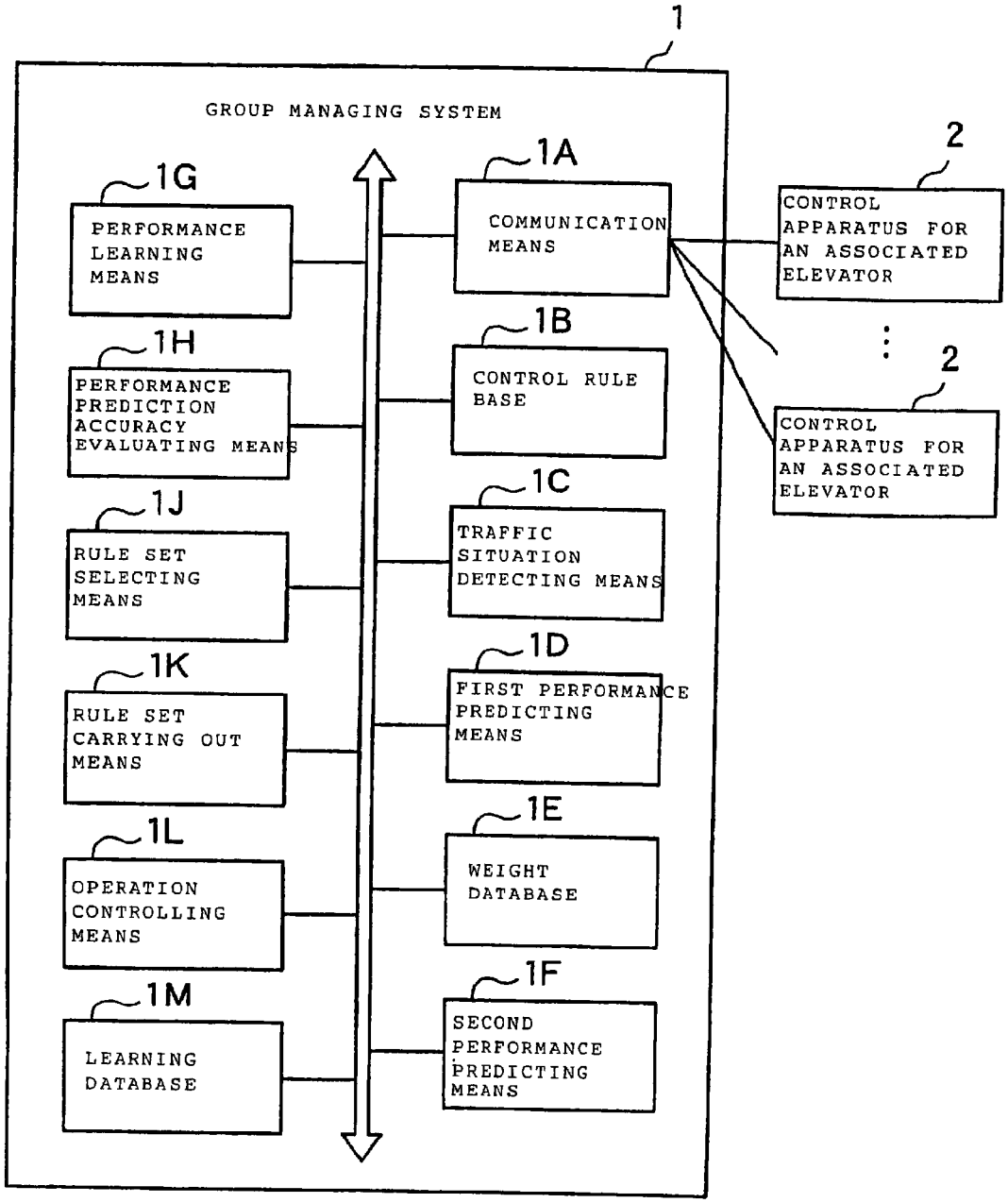
FIG. 1 is a block diagram showing a configuration of an elevator group managing system according to the present invention.
Figure 2:
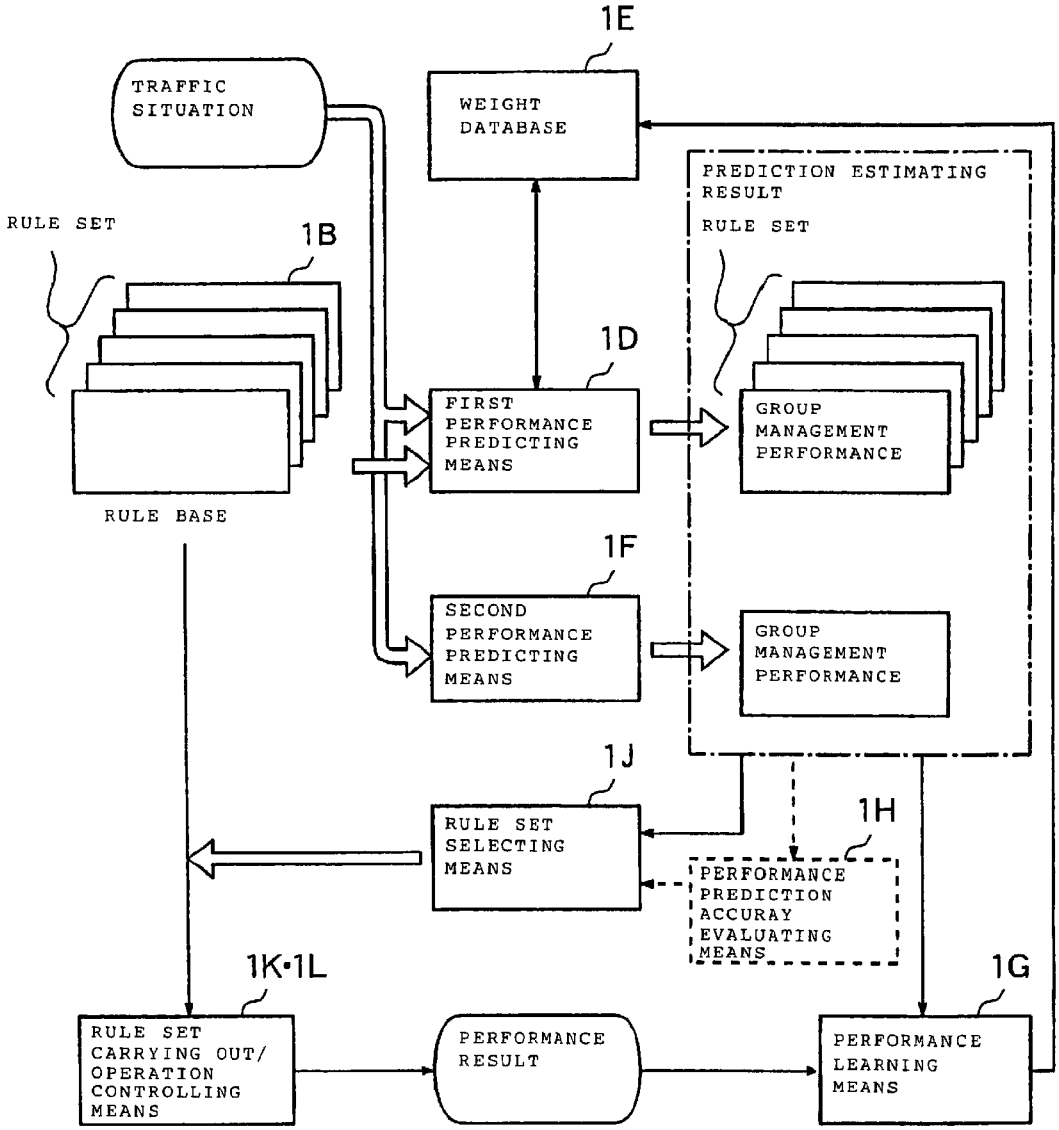
FIG. 2 is a functional association diagram of constituent elements provided in the elevator group managing system shown in FIG. 1.

FIG. 1 is a block diagram showing a configuration of an elevator group managing system according to the present invention, and FIG. 2 is a functional association diagram of constituent elements provided in the elevator group managing system shown in FIG. 1.

In these figures, reference numeral 1 designates a group managing system for managing a plurality of elevators in a group, and reference numeral 2 designates an associated elevator control apparatus for controlling an associated one of the elevators.

The above-mentioned group managing system 1 includes: communication means 1A for communicating with associated elevator control apparatuses 2; a control rule base 1B for storing therein a plurality of control rule sets, required for the group management control, such as a rule for allocation of elevators by zone based on the forwarding operation and the zone division/assignment evaluation system; traffic situation detecting means 1C for detecting the current traffic situation such as the number of passengers getting on and off the associated one of the elevators; first performance predicting means 1D for predicting the group management performance such as the waiting time distribution which is obtained when applying the specific rule set stored in the above-mentioned rule base 1B using the neural net under the traffic situation which is detected by the above-mentioned traffic situation detecting means 1C; a weight database 1E for storing therein the weight parameters of the neural net corresponding to an arbitrary rule set stored in the above-mentioned control rule base 1B; and second performance predicting means 1F for on the basis of the mathematical model, predicting the group management performance which is obtained when applying an arbitrary rule set containing the probability model under the traffic situation which has been detected by the above-mentioned traffic situation detecting means 1C.

The above-mentioned group managing system 1 further includes:

performance learning means 1G for carrying out the learning for the neural net of the above-mentioned first performance predicting means 1D to enhance the accuracy of predicting the group management performance; performance prediction accuracy evaluating means 1H for comparing the prediction results provided by the above-mentioned first performance predicting means 1D and the above-mentioned second performance predicting means 1F with the actually measured group management performance to evaluate the prediction accuracy of the first performance predicting means 1D; rule set selecting means 1J for selecting the optimal rule set in accordance with the prediction results provided by the above-mentioned first performance predicting means 1D and the above-mentioned second performance predicting means 1F; rule set carrying out means 1K for carrying out the rule set which has been selected by the above-mentioned rule set selecting means 1J; operation controlling means 1L for carrying out the overall operation control for each of the elevator cars on the basis of the rule which has been carried out by the above-mentioned rule set carrying out means 1K; and learning database 1M for storing therein the learning data.

The group managing system 1 is configured by including the above-mentioned constituent elements and also each of the constituent elements is constructed in the form of the software on the computer.

Next, the operation of the present embodiment will hereinbelow be described with reference to the associated figures.

Figure 3:
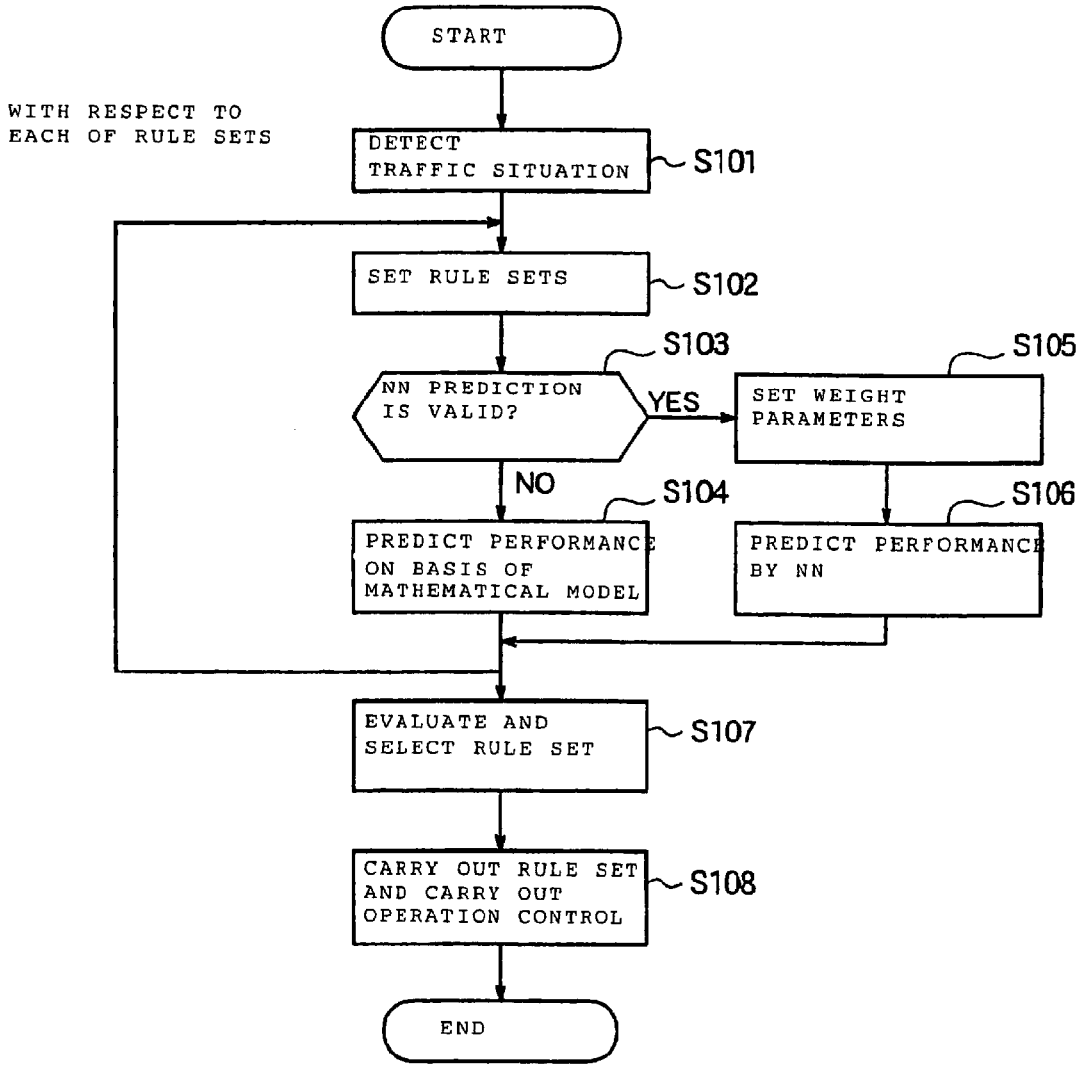
FIG. 3 is a flow chart in explaining the operation of the control procedure in the group managing system in an embodiment of the present invention.
Figure 4:
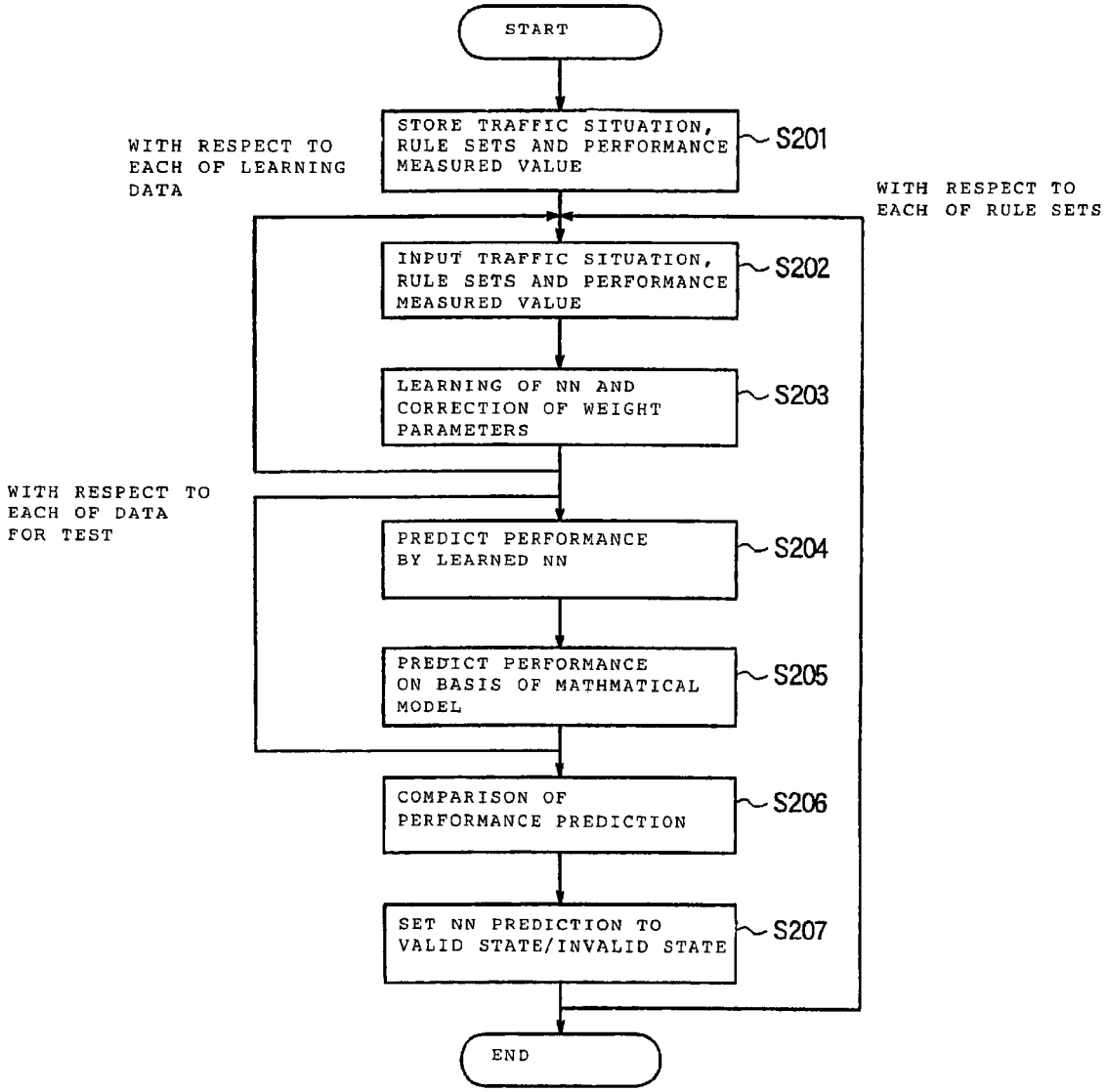
FIG. 4 is a flow chart explaining the learning procedure in the group managing system in an embodiment of the present invention.

FIG. 3 is a flow chart useful in explaining the schematic operation in the control procedure of the group managing system 1 of the present embodiment, and FIG. 4 is likewise a flow chart useful in explaining the schematic operation in the learning procedure of the group managing system 1.

First of all, the description will hereinbelow be given with respect to the schematic operation in the control procedure with reference to FIG. 3.

In Step S101, the demeanor of each of the elevator cars is monitored through the communication means 1A, and also the traffic situation, e.g., the number of passengers getting on and off the associated one of the elevators in each of the floors is detected by the traffic situation detecting means 1C. For the data describing this traffic situation, for example, the accumulated value per time (e.g., for five minutes) of the number of passengers getting on and off the associated one of the elevators in each of the floors. Alternatively, the OD (Origin and Destination: the movement of passengers from one floor to another floor) estimate may also be employed which is obtained on the basis of the well known method as disclosed in Japanese Patent Application Laid-open No.Hei 10-194619 for example.

Next, in Step S102, an arbitrary rule set is fetched from the control rule base 1B to be set. In subsequent Step S103, it is judged whether the neural net prediction is valid or invalid to the rule set thus set (in this connection, in FIG. 3, reference symbol NN represents the neural net). As a result of the judgement, if invalid (NO in Step S103), then the processing proceeds to Step S104, while if valid (YES in Step S103), then the processing proceeds to Step S105.

In this connection, in the above-mentioned Step S103, the procedure of judging whether the neural net is valid or invalid is carried out, as one example, on the basis of a result of judging whether or not the prediction accuracy is ensured now after the neural net has completed the learning. More specifically, it is judged on the basis of the value of a neural net prediction flag which is set in Step S207 in the learning procedure shown in FIG. 4 which will be described later.

When it is judged in the above-mentioned Step S103 that the neural net prediction is invalid, in Step S104, the prediction of the group management performance based on the mathematical model is carried out by the second performance predicting means 1F. While in this procedure, the queue theory or the like may be employed, that prediction may also be calculated on the basis of the iteration method as hereinbelow shown instead.

$$RTT=f(RTT)$$

Now, RTT represents a Round Trip Time of the elevator car. Then, for example, it is described in Japanese Patent Examined Publication No.Hei 1-24711 that the relation between the mean waiting time and the number of floors in which the associated one of the elevators is stopped is obtained due to the elevator car round trip time RTT. That is, f(RTT) is the function of calculating the group management performance such as the elevator car service intervals at which the associated one of the elevator cars reaches an arbitrary floor, the stop probability, the probability of the passengers getting on and off the associated one of the elevators and the waiting time from the restriction of the elevator car demeanor due to the application of the elevator car round trip time RTT which has been set, the traffic situation data and the rule set. Then, these factors can be calculated on the basis of the theory of probability. As for the prior art showing one example of the calculation method relating thereto, there is given an article of "Theory and Practice of Elevator Group Managing System": 517th short course teaching materials of the Japan Society of Mechanical Engineers (Theory and Practice of Control in Traffic Machine, Mar. 9, 1981, Tokyo).

On the other hand, when it is judged in the above-mentioned Step S103 that the neural net prediction is valid, first of all, in Step S105, the weight parameters of the neural net corresponding to the rule set which has been set are fetched from the weight database 1E to be set. Then, in Step S106, there is carried out the prediction of the group management performance by the neural net using the weight parameters which have been set by the first performance predicting means 1D.

The neural net which is used in the first performance predicting means 1D sets the group management performance such as the traffic situation data as its input and the waiting time distribution as its output to carry out the learning in Step S203 in the learning procedure shown in FIG. 4 which will be described later, whereby the prediction becomes possible with accuracy of some degree.

The procedures ranging from Step S102 to Step S106 are carried out for a plurality of rule sets which are previously prepared within the control rule base 1B, respectively.

Next, in Step S107, the performance prediction result for each of the rule sets is evaluated by the rule set selecting means 1J to select the best rule set of them. Then, in Step S108, the rule set which has been selected in Step S107 is carried out by the rule set carrying out means 1K to transmit the various kinds of instructions, the constraint condition and the operation method to the operation controlling means 1L so that the operation control based on the instructions and the like which have been transmitted by the operation controlling means 1L is carried out.

Above, the description of the schematic operation of the control procedure in the present embodiment has been completed.

Subsequently, the description will hereinbelow be given with respect to the schematic operation of the learning procedure with reference to FIG. 4.

First of all, in Step S201, the result of the group management performance which has been obtained through the control procedure shown in FIG. 3 by the performance learning means 1G, the traffic situation at that time and the applied rule set are stored at regular intervals. Then, after the applied rule set, the traffic situation to which that rule set has been applied, and the group management performance after the application of that rule set are put in order in the form of the data set, a part of the data set is stored as the data for the test in the subsequent learning procedure in the learning database 1M and also the remaining data set is stored as the learning data therein.

Next, in Step S202, each of the learning data which has been stored in Step S201 is read out from the learning database 1M by the performance learning means 1G to be inputted. Then, in Step S203, the weight parameters corresponding to the used rule set is set in the neural net using each of the learning data by the performance learning means 1G to carry out the learning of the neural net with the traffic situation data as the input and the measured group management performance as the output. In this connection, for the learning of this neural net, the well known Back Propagation Method may be employed. In addition, in this Step S203, the weight parameters which have been corrected by the learning are stored in the weight data base 1E. The procedures in the above-mentioned Step S202 and S203 are carried out with respect to each of the learning data.

After the learning of the neural net and the correction of the w eight parameters by the learning have been completed with respect to each of the learning data on the basis of the procedure as described above, subsequently, in order to check the ability of the rule sets, each of the data for the test is temporarily inputted to obtain the predictor thereof.

That is, in Step S204, by using the data for the test which has been stored in the learning database 1M in the above-mentioned Step S201, the prediction of the group management performance made by the neural net in which the learning has been carried out for the corresponding rule set and traffic situation is carried out by the first performance predicting means 1D.

In addition, in Step S205, the prediction of the group management performance based on the mathematical model is carried out by the second performance predicting means 1F.

The procedures in Step S204 and Step S205 are carried out for each of the data for the test.

Next, in Step S206, each of the prediction results which have been predicted in Step S204 and Step S205 and the performance which has been measured are compared with each other by the performance prediction accuracy evaluating means 1H. For this comparison, for example, the following error may be made the index. That is, the performance predicting means having the smaller error ERR obtained on the basis of the following expression is regarded as the performance predicting means having the more excellent prediction accuracy.

$$ERR=\Sigma|X_k-Y_k|^2/N(k=1, 2, \ldots, N)$$

where ERR represents the error, N represents the number of data for the test, $X_k$ represents the performance measured value vector, and $Y_k$ represents the performance predicted value vector.

Then, in Step S207, when as a result of the comparison in the above-mentioned Step S206, the first performance predicting means 1D has the more excellent prediction accuracy, a neural net prediction flag is set to the valid state by the performance prediction accuracy evaluating means 1H. Otherwise, the neural net prediction flag is set to the invalid state. This neural net prediction flag is used in the judgement in Step S103 of the control procedure shown in FIG. 3. In this connection, the procedures of the above-mentioned Steps S202 to S207 are carried out every rule set.

As set forth hereinabove, according to the present invention, in an elevator group managing system for managing a plurality of elevators in a group, a rule base for storing therein a plurality of control rule sets such as a rule for allocation of elevators by zone is prepared, group management performance such as the waiting time distribution which is obtained when applying an arbitrary rule set stored in the rule base to the current traffic situation is predicted, and the optimal rule set is selected in accordance with the performance prediction result. Therefore, there is offered the effect that the optimal rule set can be applied at all times to carry out the group management control and hence it is possible to provide the excellent service.

The elevator group managing system further includes a weight database for storing therein weight parameters of a neural net corresponding to an arbitrary rule set stored in the rule base, wherein for the specific rule set stored in the rule base, the weight parameters of the neural net corresponding to the specific rule set are fetched from the weight database, and the prediction of the group management performance by the neural net using the weight parameters thus fetched is carried out. Therefore, there is offered the effect that the learning of the neural net can be carried out every part corresponding to the associated one of the rule sets and hence it is possible to enhance the prediction accuracy.

The elevator group managing system further includes performance learning means for comparing the prediction result of the group management performance with the actual group management performance after having applied the specific rule set to carry out the learning of the neural net to correct the weight parameters stored in the weight database in accordance with the learning result, wherein the prediction of the group management performance by the neural net using the corrected weight parameters. As a result, there is offered the effect that it is possible to enhance the prediction accuracy in correspondence to the actual operating situation of a plurality of elevators.

In addition, the round trip time of each of the elevator cars which is predicted when applying an arbitrary rule set stored in the rule base to the current traffic situation is mathematically calculated and the group management performance such as the waiting time is predicted on the basis of the mathematical model from the round trip time and the traffic situation. As a result, there is offered the effect that the group management performance can be predicted without carrying out the prediction by the neural net and also it is possible to enhance the prediction accuracy thereof.

Furthermore, an elevator group managing system for managing a plurality of elevators in a group includes: traffic situation detecting means for detecting the current traffic situation of a plurality of elevators; a rule base for storing therein a plurality of control rule sets; first performance predicting means for on the basis of a neural net, predicting the group management performance which is obtained when applying an arbitrary rule set stored in the rule base to the current traffic situation; a weight database for storing therein weight parameters of the neural net corresponding to the arbitrary rule set stored in the rule base; and performance learning means for comparing the prediction result provided by the first performance predicting means with the actual group management performance after having applied the specific rule set to carry out the learning of the neural net to correct the weight parameters stored in the weight database in accordance with the learning result, wherein the first performance predicting means carries out the prediction of the group management performance by the neural net using the corrected weight parameters, the system further including: second performance predicting means for on the basis of the mathematical model, predicting the group management performance which is predicted when applying an arbitrary rule set stored in the rule base to the current traffic situation; performance prediction accuracy evaluating means for comparing the prediction results provided by the first and second performance predicting means with the actual group management performance to determine which of the first or second performance predicting means is employed in accordance with the comparison result; rule set selecting means for selecting the optimal rule set in accordance with the prediction result, from either the first or second performance predicting means, which has been determined by the performance prediction accuracy evaluating means; and operation controlling means for carrying out the operation control for each of the elevator cars on the basis of the rule set which has been selected by the rule set selecting means. As a result, there is offered the effect that it is possible to enhance the accuracy of the performance prediction in accordance with the actual operating situation of a plurality of elevators, even when the traffic situation is abruptly changed due to the change in the initial state or the change of tenants within an associated building in which a plurality of elevators are installed, it is possible to carry out the performance prediction with high accuracy, and also on the basis of that prediction, the group management control can be carried out using the optimal rule set at all times.

INDUSTRIAL APPLICABILITY

According to the present invention, a rule base for storing therein a plurality of control rule sets is prepared, group management performance such as the waiting time distribution which is obtained when applying an arbitrary rule set stored in the rule base to the current traffic situation is predicted, and the optimal rule set is selected in accordance with the performance prediction result, whereby the optimal rule set can be applied at all times to carry out the group management control and hence it is possible to provide the excellent service.

What is claimed is:

1. An elevator group managing system for managing a plurality of elevators in a group, said elevator group managing system comprising:

traffic situation detecting means for detecting a current traffic situation of a plurality of elevators;

a rule base storing a plurality of control rule sets;

performance predicting means for predicting group management performance obtained when applying each rule set stored in said rule base to the current traffic situation;

rule set selecting means for selecting an optimal rule set from said rule base in accordance with the group management performance predicted by said performance predicting means;

operation controlling means for operation control of each of the elevator cars based on the rule set selected by said rule set selecting means; and a weight database storing weighting parameters of a neural network corresponding to each rule set stored in said rule base, wherein said performance predicting means determines whether a neural network prediction is valid or invalid for each rule set stored in said rule base, and, when the neural network prediction is valid fetches, the weighting parameters of the neural network corresponding to the rule set from said weight database and predicts the group management performance and, when the neural network prediction is invalid, predicts the group management performance when each rule set stored in the said rule base is applied to the current traffic situation based on a mathematical model.

2. The elevator group managing system according to claim 1, further comprising performance learning means for comparing the group management performance predicted by said performance predicting means with actual group management performance after having applied the rule set selected to carry out learning by the neural network to correct the weighting parameters stored in said weight database in accordance with the learning, wherein said performance predicting means predicts the group management performance by the neural network using the weighting parameters after correction.

3. An elevator group managing system for managing a plurality of elevators in a group, said elevator group managing system comprising:

traffic situation detecting means for detecting a current traffic situation of a plurality of elevators;

a rule base storing a plurality of control rule sets;

first performance predicting means for, based on a neural network, predicting group management performance obtained when applying each rule set stored in said rule base to the current traffic situation;

a weight database storing weighting parameters of a neural network corresponding to each rule set stored in said rule base;

performance learning means for comparing the group management performance predicted by said performance predicting means with actual group management performance after having applied a rule set selected to carry out learning by. the neural network to correct the weighting parameters stored in said weight database, in accordance with the learning, wherein said first performance predicting means predicts the group management performance through the neural network using the weighting parameters after correction;

second performance predicting means for, based on a mathematical model, predicting the group management performance when each rule set stored in said rule base is applied to the current traffic situation;

performance prediction accuracy evaluating means for comparing the group management performance prediction provided by said first performance predicting means and said second performance predicting means with actual group management performance to select which of said first performance predicting means and said second performance predicting means is to be employed;

rule set selecting means for selecting the rule set in accordance with the prediction, from whichever of said first performance prediction means and said second performance predicting means has been selected by said performance prediction accuracy evaluating means; and operation control means for operation control for each of the elevator cars based on the rule set selected by said rule set selecting means.

* * * * *